US010673192B1

(12) United States Patent
Liu

(10) Patent No.: US 10,673,192 B1
(45) Date of Patent: Jun. 2, 2020

(54) POWER PLUG ADAPTER

(71) Applicant: Shenzhen Ouli Technology Co., Ltd., Shenzhen (CN)

(72) Inventor: Song Liu, Shenzhen (CN)

(73) Assignee: SHENZHEN OULI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/423,439

(22) Filed: May 28, 2019

(51) Int. Cl.
*H01R 31/06* (2006.01)
*H01R 27/00* (2006.01)

(52) U.S. Cl.
CPC ..... *H01R 31/06* (2013.01); *H01R 27/00* (2013.01)

(58) Field of Classification Search
CPC ..... H01R 27/00; H01R 31/06; H01R 29/00; H01R 24/66; H01R 33/90
USPC ..... 439/171–173
See application file for complete search history.

(56) References Cited

U.S. PATENT DOCUMENTS 7,220,139 B1 * 5/2007 Chang ..... H01R 31/06 439/172
7,857,639 B1 * 12/2010 Chang ..... H01R 31/06 439/131
8,157,578 B2 * 4/2012 Lee ..... H01R 31/06 439/172
8,182,276 B2 * 5/2012 Ruffner ..... H01R 24/78 439/172
8,197,273 B1 * 6/2012 Lee ..... H01R 31/06 439/172

* cited by examiner

*Primary Examiner* — Hien D Vu
(74) *Attorney, Agent, or Firm* — Hemisphere Law, PLLC

(57) ABSTRACT

A power plug adapter includes a housing assembly, four plug assemblies movably arranged on the housing assembly, two rotating columns vertically arranged in the housing assembly and only rotating around an axis, and a movable pin arranged between the two rotating columns in an abutting mode. The plug assemblies are arranged in correspondence with one or more plastic bodies, one or more plug pins fixed on the plastic bodies, and one or more sliding buttons connected to the end of each of the plastic bodies. One or more sliding grooves for the sliding buttons to slide are provided on a shell of the housing assembly. In this construction, interlocking among the four plug assemblies can be achieved. The requirement of design, manufacture and assembly precision for the plug assembly and rotating column of the present invention are relatively decreased, and the possibility of a stuck fault is reduced.

9 Claims, 16 Drawing Sheets

POWER PLUG ADAPTER

TECHNICAL FIELD

The present invention relates to the technical field of electrical connectors, and more particularly to a power plug adapter.

BACKGROUND

With the development of society and economy, more and more people travel and do business abroad. To make the trip more convenient, people often choose to bring some corresponding communication equipment or electronic products, such as notebook computer, mobile phone, IPAD and the like. The electronic products are all power consuming products and usually need to be connected with a power source for charging. At present, different standards of power socket interface are adopted by different countries, such as a US standard, a UK standard, an Au standard and the like. It is necessary to prepare different types of power plug adapter. Therefore, the power plug adapter that meets different national standards comes out.

At present, a power plug adapter is generally the combination of a plurality of plugs of different countries. An interlocking assembly is usually arranged to prevent the other sets of plugs from extending out when one set of plugs is selected. In Chinese patent with a publication number CN109038143A, a power plug adapter is arranged a rotating column which can only rotate around an axis in a vertical direction. When a sliding button of a plug assembly slides upwards from the bottom to the top of a sliding groove, a corresponding pin passes through a pin slot arranged on a housing assembly. Meanwhile, a corresponding plastic body drives the rotating column to rotate by a certain angle and then the plastic bodies of other plug assemblies are prevented. Therefore, the interlocking effect among the plug assemblies can be achieved. However, when the number of plug assembly is more than four, the requirement of design, manufacture and assembly precision for the internal structure of such power plug adapter are relatively high, and it is easy to stuck when in use.

SUMMARY OF THE INVENTION

Therefore, a power plug adapter is provided in the present invention, which aims to solve the following problem in the prior art: when the number of plug assembly in a power plug adapter is four, the requirement of design, manufacture and assembly precision for the internal structure are relatively high, and it is easy to stuck when in use.

According to the invention, a power plug adapter includes a housing assembly, four plug assemblies, two rotating columns and a movable pin. Each of the plug assemblies is movably arranged on the housing assembly to meet different standards. Each of the rotating columns is vertically arranged in the housing assembly and can only rotate around an axis. The movable pin is arranged between the two rotating columns in an abutting mode. Each of the plug assemblies includes one or more plastic bodies, one or more plug pins fixed on the plastic bodies, and one or more sliding buttons connected to the end of each of the plastic bodies. A plurality of sliding grooves for the sliding buttons to slide is provided on a shell of the housing assembly. When the sliding buttons slide upwards from the bottom to the top of one of the sliding grooves, the corresponding plug pin passes through a pin slot arranged on the housing assembly. Meanwhile, the corresponding plastic body drives one of the two rotating columns to rotate to a preset angle and the movable pin locks the other rotating column, and the plastic bodies of other plug assemblies are resisted.

In a preferred embodiment, a guide groove and two guide surfaces are arranged on a peripheral wall of the two rotating columns. The guide groove extends in an axial direction. The two guide surfaces are symmetrically arranged on two sides of the guide groove and extend to the bottom of the guide groove. One end of the two rotating columns are provided with fan-shaped grooves, and two ends of the movable pin are V-shaped and abut in the two fan-shaped grooves. Each of the plastic bodies is convexly provided with a poking part matched with the width of the guide groove. When sliding the corresponding sliding button upwards from the bottom of one of the sliding grooves, the poking part can slide into the guide groove along one of the two guide surfaces.

In a preferred embodiment, each of the guide surfaces is inclined curved.

In a preferred embodiment, one side of the poking part is arc-shaped to match with the bottom of the guide groove.

Further, the power plug adapter includes a locking assembly which is elastically connected in the housing assembly. The locking assembly includes a bottom plate and a plurality of supporting columns extending from the bottom plate in the direction of each of the sliding grooves. The plastic bodies on the plug assemblies are clamped on the corresponding supporting column when the corresponding plug pin extends out.

In a preferred embodiment, at least one supporting part is arranged on the plastic bodies. A cutting groove that supports the supporting part is arranged on the top of the corresponding supporting column. At least one inclined surface is arranged on the side close to the bottom of each of the supporting columns. The inclined surface is used for abutting against the corresponding supporting part in an initial state.

In a preferred embodiment, the housing assembly comprises a supporting block fixedly arranged inside the shell. A plurality of first springs is arranged between the supporting block and the locking assembly in an abutting mode.

Further, the power plug adapter includes at least four guide columns which are fixed on a bottom shell of the housing assembly. The corresponding guide column is inserted in each of the plastic bodies of the four plug assemblies.

In a preferred embodiment, the power plug adapter includes second springs in which each of the guide columns is inserted. Each of the second springs is respectively abutted between the housing assembly and each of the four plug assemblies.

In a preferred embodiment, the plug assemblies conform to the following country standards: EURO, UK, AU, and US.

Compared with the prior art, the technical effects of the present invention are as follows. Two rotating columns which can only rotate around an axis in the vertical direction are arranged inside a housing assembly of a power plug adapter. Each of the two rotating columns is configured to be adapted to only two adjacent plug assemblies. When a sliding button slides upwards from the bottom to the top of a corresponding sliding groove, a corresponding pin passes through a pin slot arranged on the housing assembly. Meanwhile, the corresponding plastic body drives one of the rotating columns to rotate to a preset angle and the movable pin locks the other rotating column, and the plastic bodies of other three plug assemblies are prevented. Therefore, the technical effect of interlocking among the four plug assemblies can be achieved. In present invention, the requirement of design, manufacture and assembly precision for each of the plug assemblies and rotating columns is relatively low, and the possibility of a stuck fault is reduced.

BRIEF DESCRIPTION OF THE DRAWINGS

The invention will now be described in detail with the aid of the figures, in which.

DETAILED DESCRIPTION OF THE INVENTION

Figure 1:
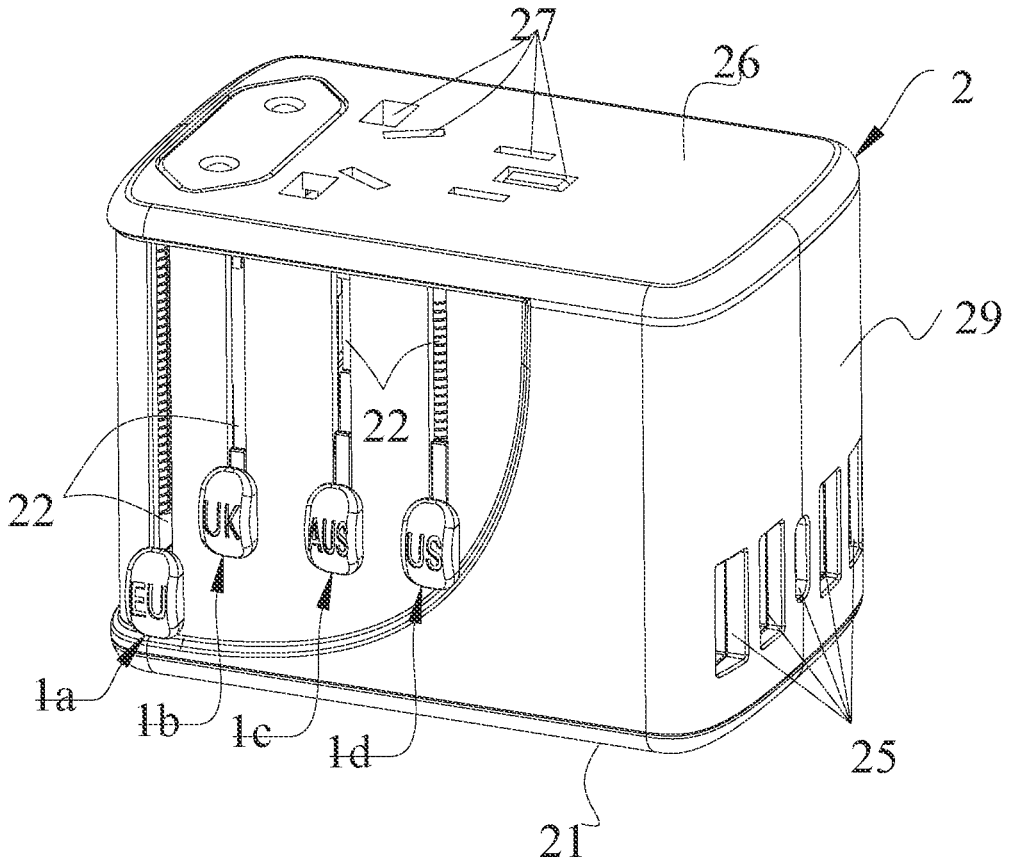
FIG. 1 is a three-dimensional view of one embodiment of the present invention.

The foregoing and other exemplary purposes, aspects and advantages of the present invention will be better understood in principle from the following detailed description of one or more exemplary embodiments of the invention with reference to the embodiment(s) and accompanied drawings. It is understood to one skilled in the art that the following description with reference to the embodiment(s) and accompanied drawings is merely to explain concepts and principals of the present invention but should not be seemed as limitation to the scope of the present invention. Examples of the embodiments are illustrated in the accompanied drawings. Wherever possible, the same reference numbers are used in the drawings and the description to refer to the same or like parts.

Please refer to FIG. 1 to FIG. 5, a power plug adapter provided in one embodiment of the present invention includes a housing assembly 2, four plug assemblies 1*a*, 1*b*, 1*c*, and 1*d*, two rotating columns 4 and a movable pin 6 abutting between the two rotating columns 4. Each of the plug assemblies 1*a*, 1*b*, 1*c*, and 1*d* is movably arranged on the housing assembly 2, and can conform to different national standards. The two rotating columns 4 are vertically arranged in the housing assembly 2, and the upper end and the lower end thereof are limited, so that the two rotating columns 4 can only rotate around an axis. The four plug assemblies 1*a*, 1*b*, 1*c*, and 1*d* respectively includes corresponding plastic bodies 10*a*, 10*b*, 10*c*, 10*d*, plug pins 14*a*, 14*b*, 14*c*, 14*d* fixed on the plastic bodies 10*a*, 10*b*, 10*c*, 10*d* and sliding buttons 15*a*, 15*b*, 15*c*, 15*d* connected to the end of the plastic bodies 10*a*, 10*b*, 10*c*, 10*d*. A plurality of sliding grooves 22 for the sliding buttons 15*a*, 15*b*, 15*c*, 15*d* to slide is provided on the housing assembly 2.

Figure 4:
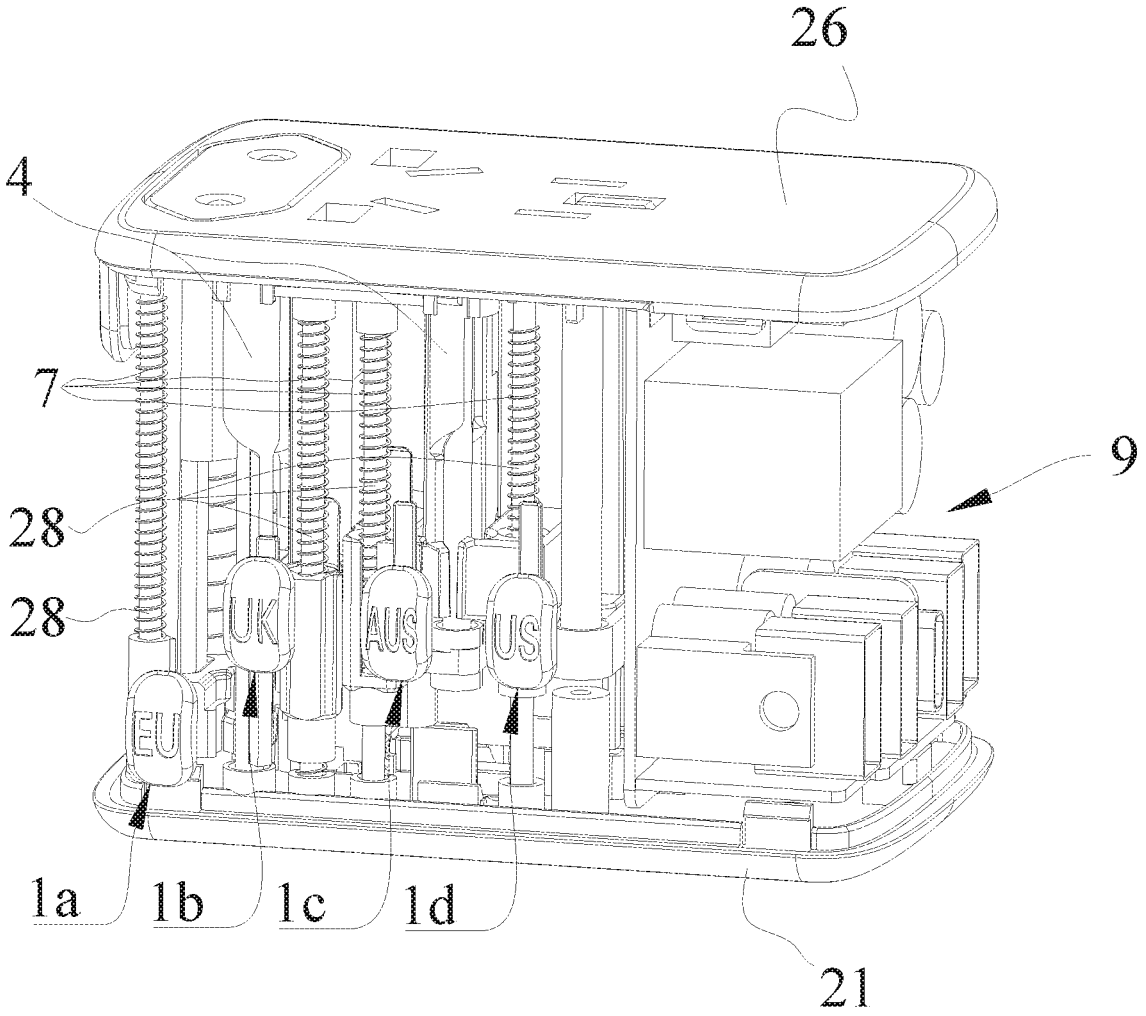
FIG. 4 is a three-dimensional view of the power plug adapter of FIG. 1 without a shell.
Figure 5:
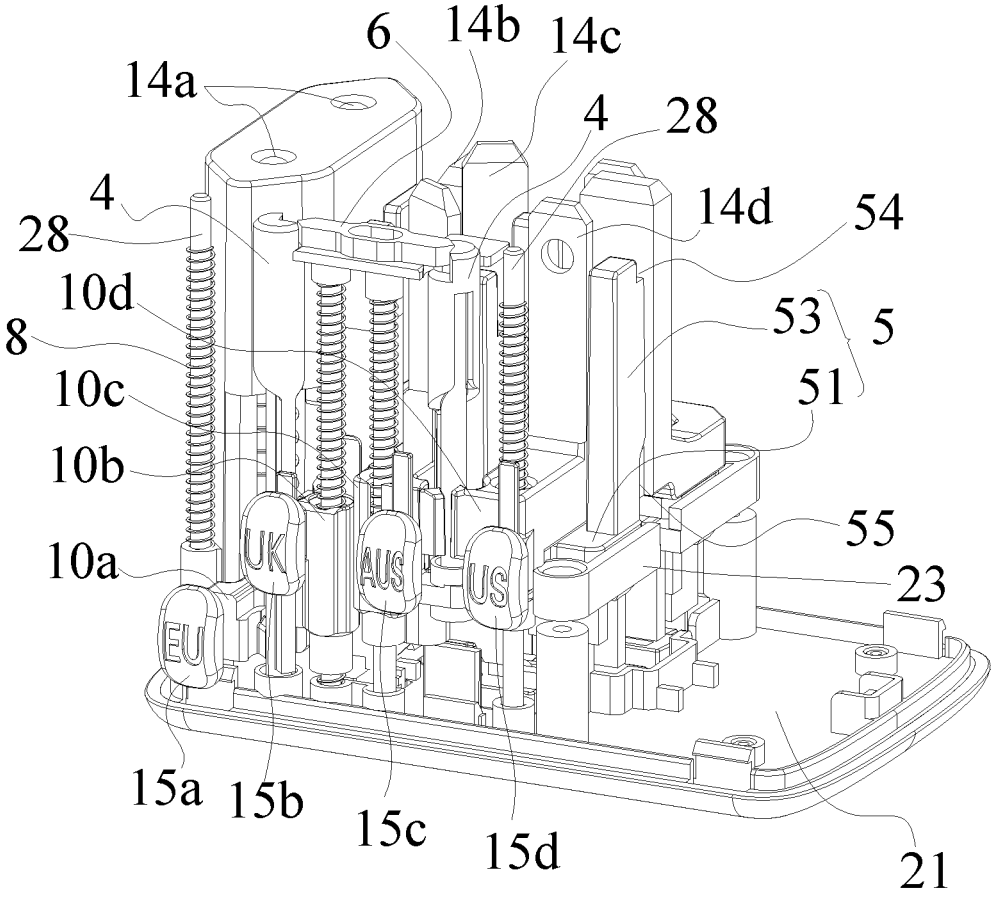
FIG. 5 is a three-dimensional view of the power plug adapter of FIG. 4 without a top shell and a PCB assembly.
Figure 6:
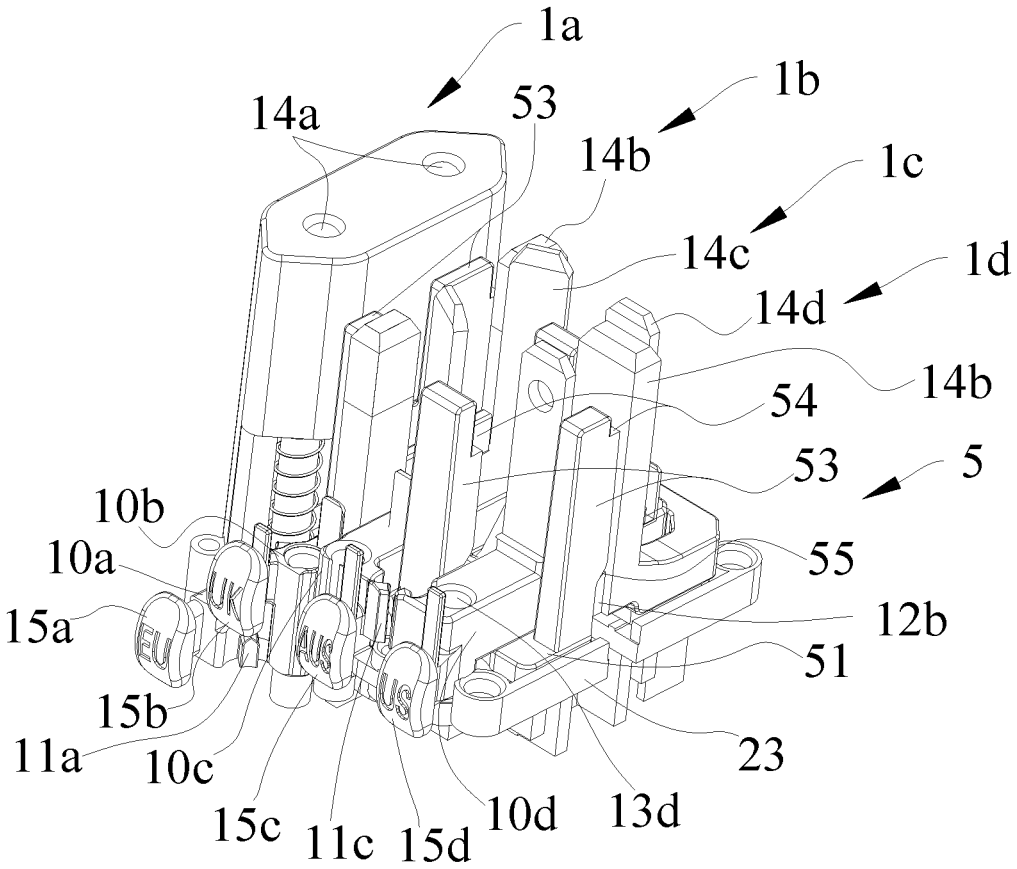
FIG. 6 is a schematic diagram of the power plug adapter of FIG. 1, with four plug assemblies, the locking assembly and the supporting block combined.
Figure 7:
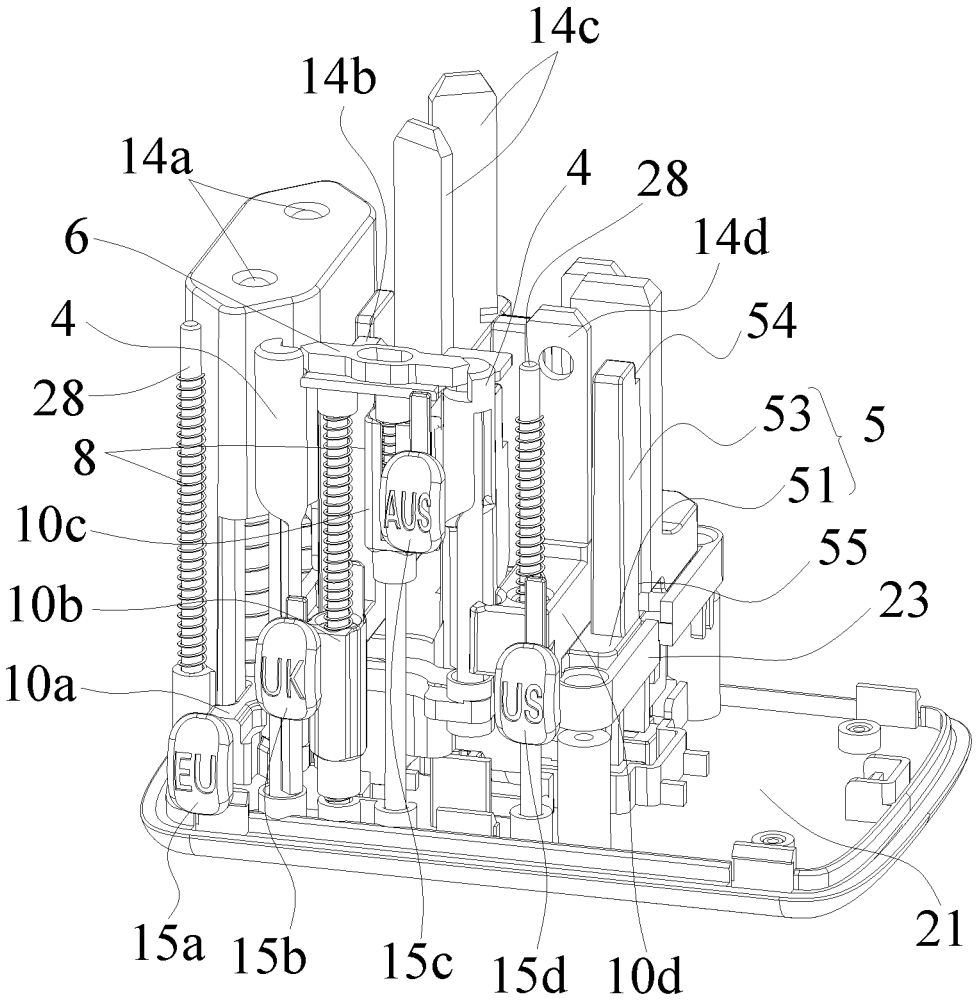
FIG. 7 is a three-dimensional view of the power plug adapter of FIG. 3 without a top shell, a housing and a PCB assembly.
Figure 8:
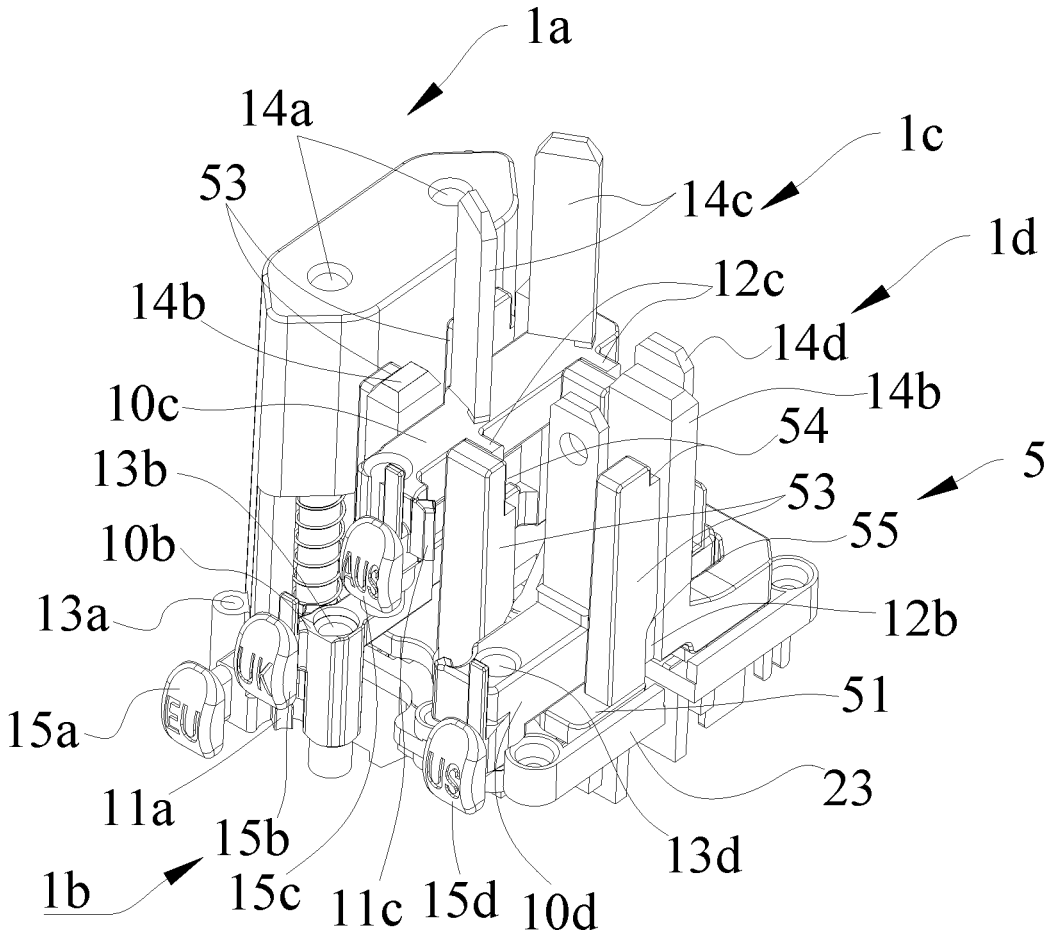
FIG. 8 is a schematic diagram of the power plug adapter of FIG. 3, with four plug assemblies, the locking assembly and the supporting block combined.

It should be noted that, as shown in FIG. 1, FIG. 4, and FIG. 6, in the present embodiment, a plurality of plug assemblies 1*a*, 1*b*, 1*c*, 1*d* conforming to different standards respectively refer to EURO plug assembly 1*a*, UK plug assembly 1*b*, AU plug assembly 1*c*, and US plug assembly 1*d*. One of the rotating columns 4 adjoins the EURO plug assembly 1*a* and the UK plug assembly 1*b* and the other one of the rotating columns 4 adjoins the AU plug assembly 1*c* and the US plug assembly 1*d*. In addition, the length of each of the sliding grooves 22 is also designed according to the standards of different countries. Of course, a plug assembly satisfying other national standards can also be provided according to the requirements of an actual use country.

With continued reference to FIGS. 3 to 9, an AU plug assembly 1*c* is used as an example. When the corresponding sliding button 15*c* slides upwards from the bottom to the top of the sliding groove 22, and the corresponding plug pin 14*c* passes through a pin slot 27 arranged on a top shell 26 of the housing assembly 2. That is, the plug pin 14*c* is moved to an effective position from an invalid position. On the effective position the plug pin 14*c* can be inserted into other external sockets, whereas on the invalid position the plug pin 14*c* is in an initial state and is not available. Meanwhile, when the sliding button 15*c* is slid, the corresponding plastic body 10*c* will drive one of the two rotating columns 4 to rotate to a preset angle and remains in a locked state. At the same time, the rotating column 4 prevents the adjacent plastic body 10*d* of US plug assembly 1*d*, and the US plug assembly 1*d* cannot slide upwards and the purpose of locking the US plug assembly 1*d* is achieved. At this time, when the rotating column 4 rolls, it will drive the movable pin 6 abutting against the end of the rotating column 4 to move horizontally, and the other rotating column 4 is locked. Meanwhile, the plastic body 10*a* of EURO plug assembly 1*a* and the plastic body 10*b* of UK plug assembly 1*b* which are adjacent to the rotating column 4 are blocked, so that the EURO plug assembly 1*a* and the UK plug assembly 1*b* cannot slide upwards and the purpose of locking the EURO plug assembly 1*a* and the UK plug assembly 1*b* is achieved.

It should be noted that sliding one of the above-mentioned plug assemblies from the invalid position to the effective position, one of the two rotating columns will rotate an angel. The above-mentioned "preset angle" refers to the final rotating angle of the rotating column. In general, for a power plug adapter with a specific structure, the angle is determined according to the number of plug assembly, the initial positions and the contact portion shape of the plastic body and the rotating column. For a specific sliding button, as long as the above parameters are determined, the rotation angle of the rotating column is fixed when sliding the plug assembly upwards from the invalid position to the effective position.

Two rotating columns of the power plug adapter can only rotate around an axis in a vertical direction inside a housing assembly. Each of the two rotating columns is configured to be adapted to only two adjacent plug assemblies. When a sliding button slides upwards from the bottom to the top of one of the sliding grooves, a corresponding plug pin passes through a pin slot arranged on the housing assembly. Meanwhile, a corresponding plastic body drives one of the two rotating columns to rotate to a preset angle and a movable pin locks the other rotating column and the plastic bodies of other plug assemblies are prevented. Therefore, the technical effect of interlocking among the four plug assemblies can be achieved. In present invention, the requirement of design, manufacture and assembly precision for the plug assembly and rotating column is relatively low, and the possibility of a stuck fault is reduced. In addition, an abnormal sound phenomenon occurring in a commonly-used interlocking power adapter at present can also be avoided for the rotating column of the present invention does not shake when the power plug adapter is carried.

Referring to FIG. 1 to FIG. 4, in the embodiments of the present invention, the housing assembly 2 is detachable to facilitate assembly of internal components of a power plug adapter. The housing assembly 2 comprises a shell 29, a bottom shell 21 located at the bottom thereof, and a top shell 26 covering on it. The four plug assemblies 1*a*, 1*b*, 1*c*, 1*d* and the PCB assembly 9 are accommodated between he bottom shell 21 and the top shell 26. A plurality of sliding grooves 22 are formed on the shell 29, and the upper end surface of the top shell 26 is provided with a plurality of pin slots 27.

Figure 2:
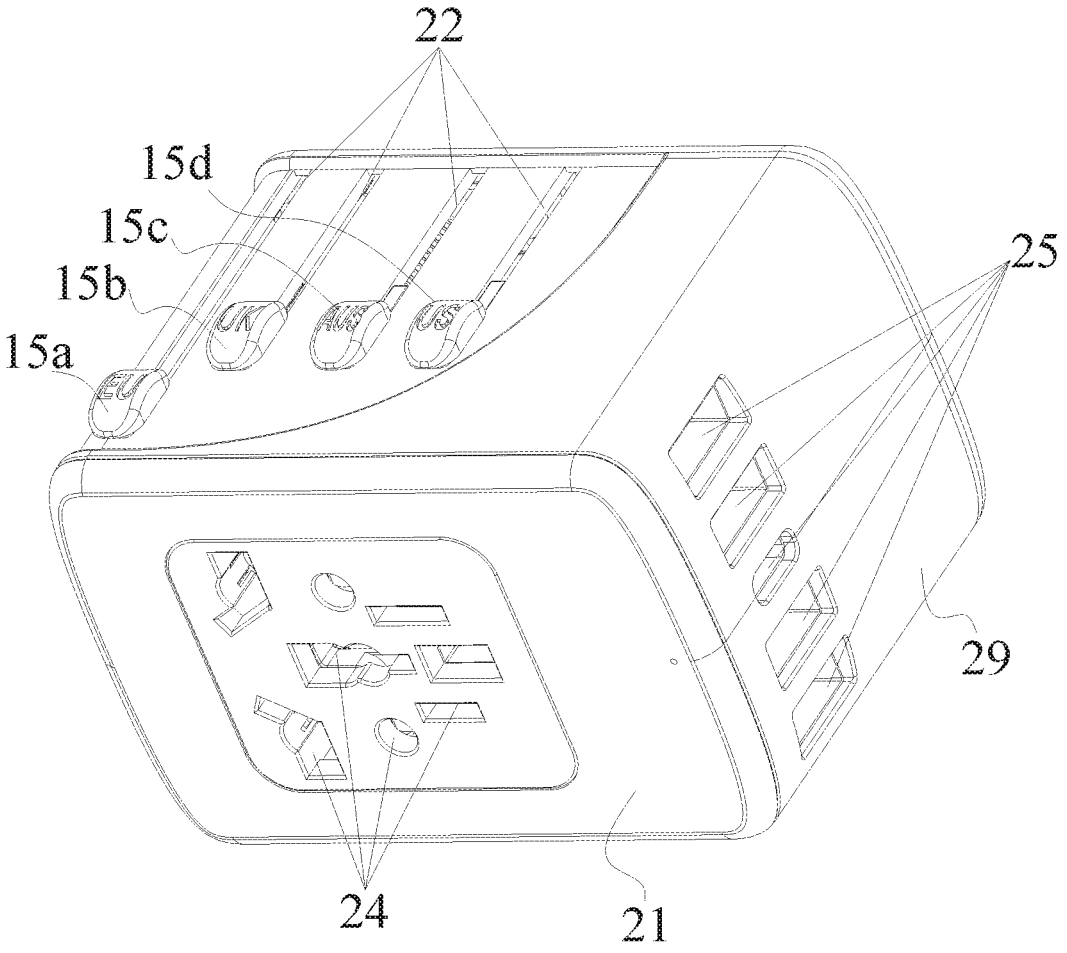
FIG. 2 is a three-dimensional view of the power plug adapter of FIG. 1 in another direction.
Figure 3:
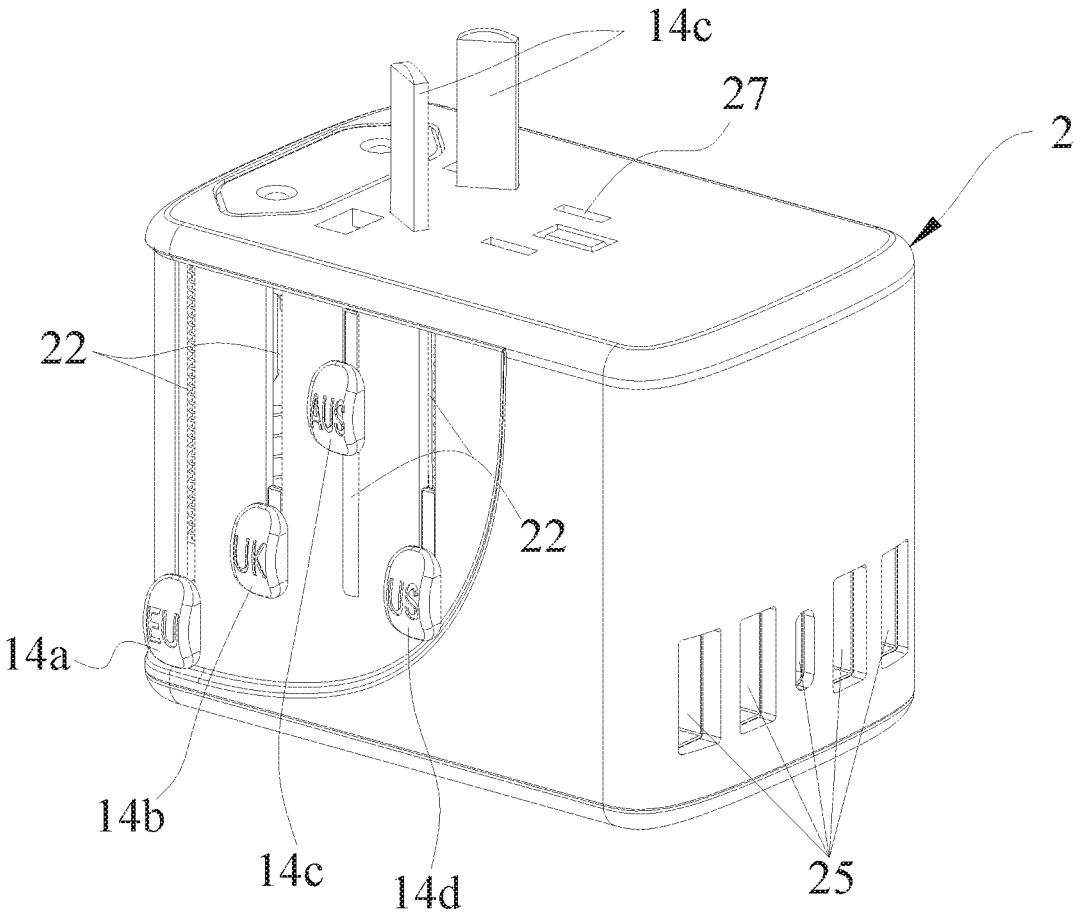
FIG. 3 is a working view of the power plug adapter of FIG. 1.

As shown in FIG. 2, the bottom shell 21 is provided with slots 24 meeting different national standards, so that a plug of another power supply can be conveniently plugged into the socket. Close to the bottom of the shell 29 is further provided with a plurality of USB interfaces 25 for low-voltage charging of electronic product, such as a mobile phone, an iPad and the like. A part of the USB interface 25 can also be designed to satisfy the form of a Type-C USB interface. In the present embodiment, four common USB interfaces and a USB interface satisfying Type-C are provided.

Figure 9:
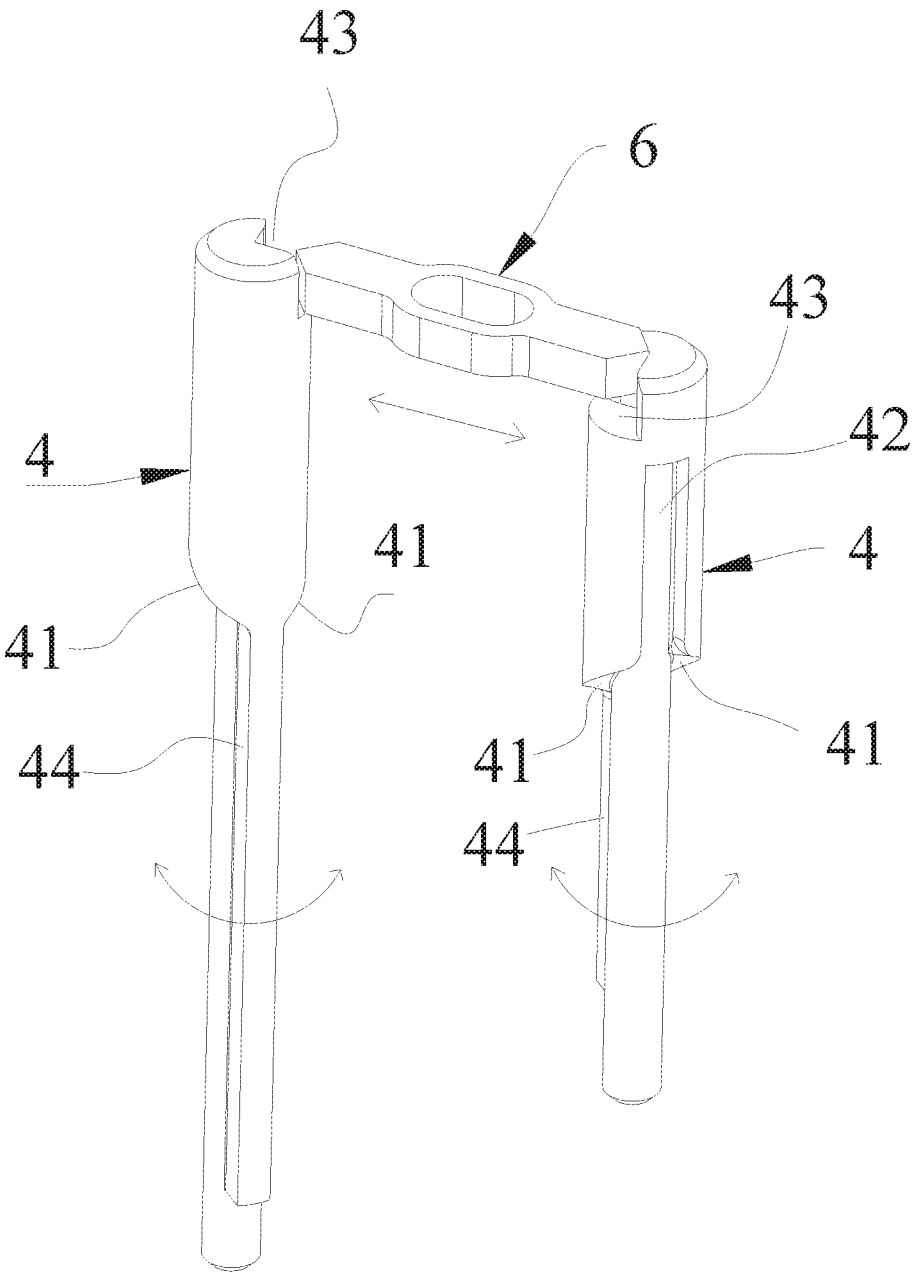
FIG. 9 is a schematic diagram of the power plug adapter of FIG. 5 or FIG. 7, with two rotating columns and the movable pin combined.
Figure 10:
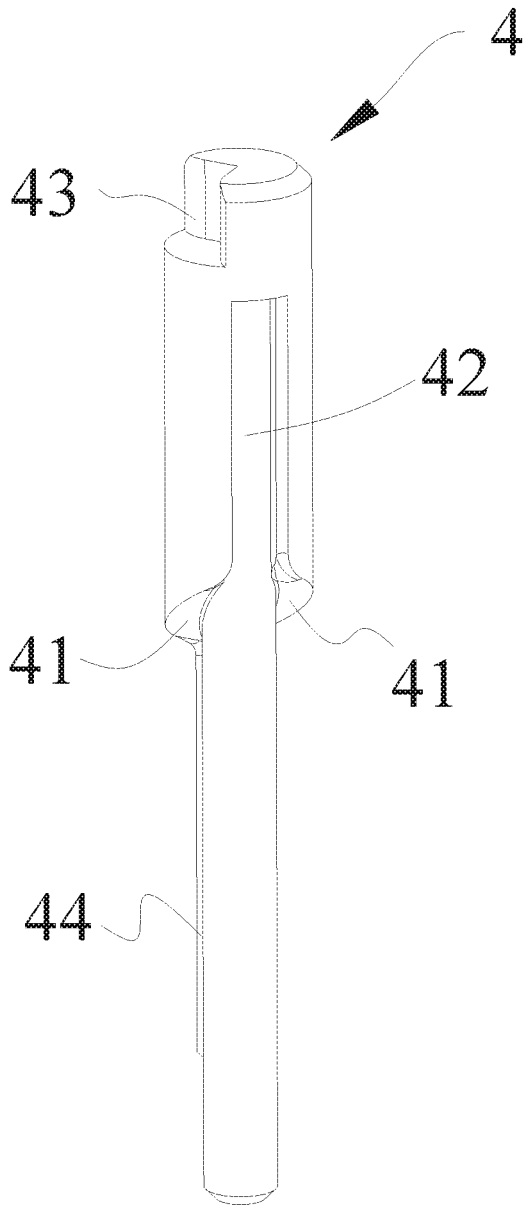
FIG. 10 is a three-dimensional view of one of the two rotating columns of FIG. 9.
Figure 11:
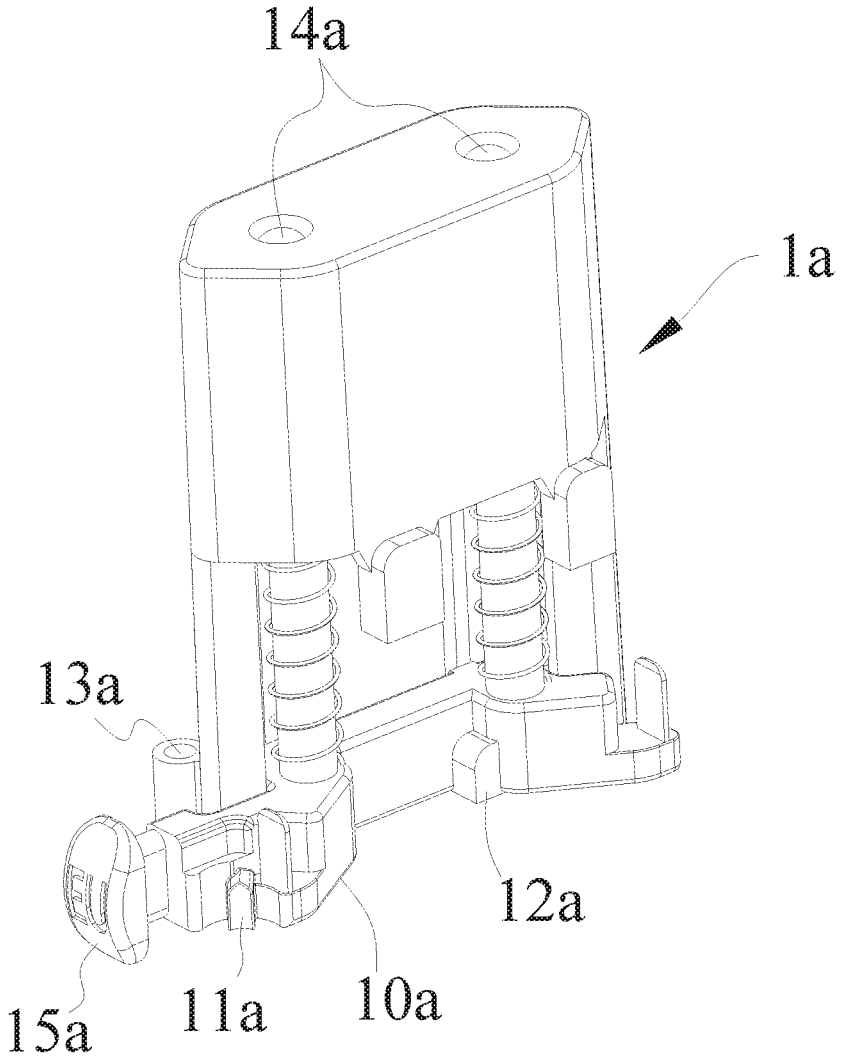
FIG. 11 is a three-dimensional view of one of the four plug assemblies of FIG. 6, conforming to European standard.
Figure 12:
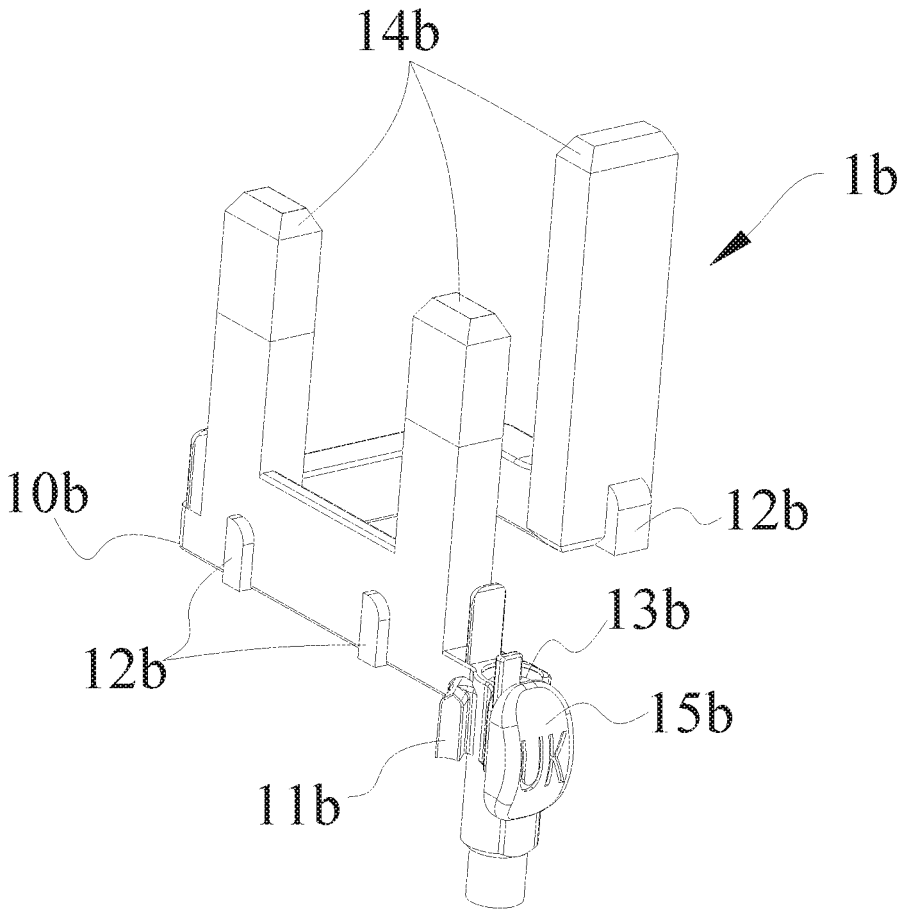
FIG. 12 is a three-dimensional view of one of the four plug assemblies of FIG. 6 conforming to British standard.
Figure 13:
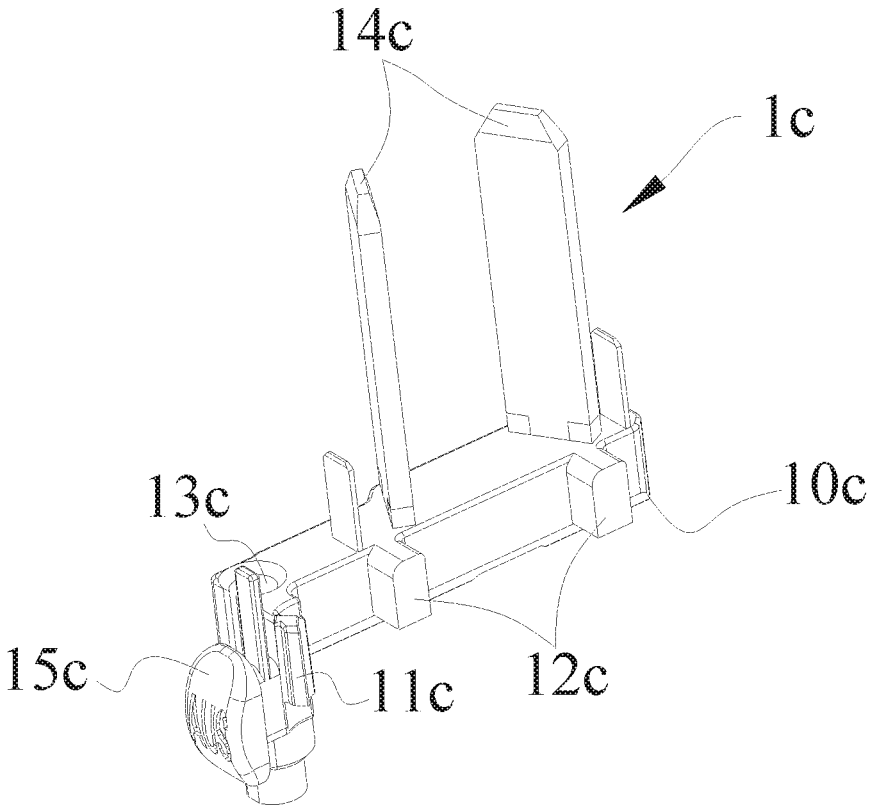
FIG. 13 is a three-dimensional view of one of the four plug assemblies of FIG. 6, conforming to Australian standard.
Figure 14:
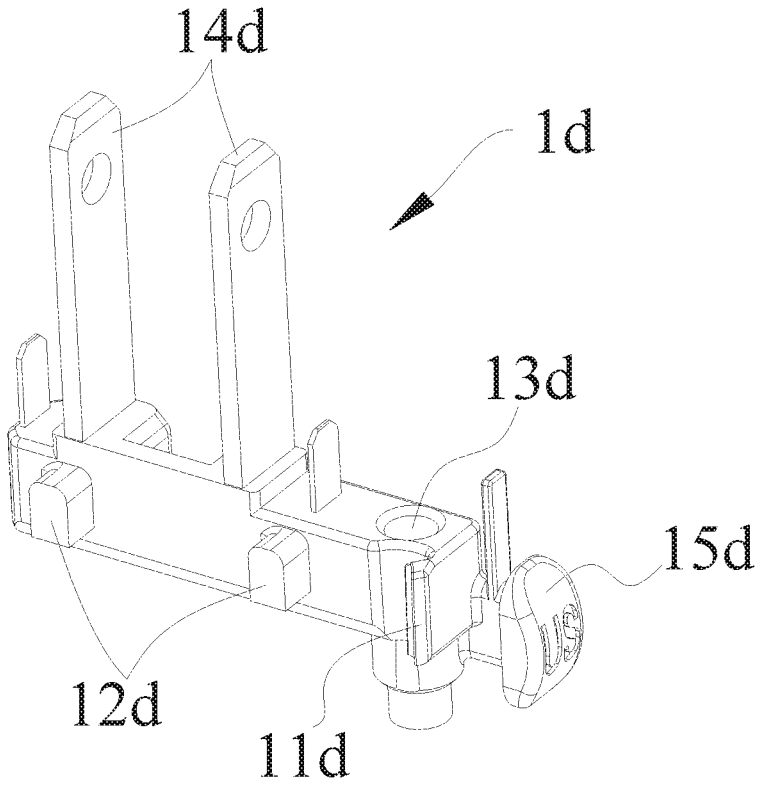
FIG. 14 is a three-dimensional view of one of the four plug assemblies of FIG. 6, conforming to US standard.

Please refer to FIG. 5 to FIG. 10, and in an embodiment of the present invention, a guide groove 42 and two guide surfaces 41 are arranged on the peripheral wall of two rotating columns 4. The guide groove 42 extends in an axial direction. Two guide surfaces 41 are symmetrically arranged on two sides of the guide groove 42 and extend to the bottom of the guide groove 42. The ends of the two rotating columns 4 are provided with two fan-shaped grooves 43, and the two ends of the movable pin 6 are V-shaped and abut against the inside of the two fan-shaped grooves 43. Each of the plastic bodies 10*a*, 10*b*, 10*c*, 10*d* is convexly provided with one of the poking parts 11*a*, 11*b*, 11 *c*, 11*d* matched with the width of the guide groove 42. When sliding the corresponding sliding buttons 15*a*, 15*b*, 15*c*, 15*d* upwards from the bottom of one of the sliding grooves 22, one of the poking parts 11*a*, 11*b*, 11*c*, 11*d* can slide into the guide groove 42 along one of the two guide surfaces 41. In the present embodiment, each top of the poking parts 11*a*, 11*b*, 11*c*, 11*d* are preferably bullet-shaped for the convenience of shifting the two rotating columns 4. Further, as shown in FIG. 9 and FIG. 10, each of the guide surfaces 41 is preferably designed to be an inclined curved surface, so that each of the poking parts 11*a*, 11*b*, 11*c*, 11*d* can be conveniently moved into the guide groove 42 and the occurrence of jamming in the sliding process can be avoided. In addition, in this embodiment, two separation bars 44 is also provided on the two rotating columns 4, and two vertical sides of each the two separation bars 44 are respectively connected to each of the guide surfaces 41. Therefore, the interference between the poking parts of the plug assemblies on the common rotating column 4 can be prevented.

As shown in FIG. 3, FIG. 5, FIG. 7 and FIG. 9, an AU plug assembly 1*c* is used as an example. By arranging one of the guide surfaces 41 on one of the corresponding rotating columns 4, the poking part 11*c* on the plastic body 10*c* can smoothly slide into the guide groove 42. Move and rotate the rotating column 4 by a certain angle, the poking part 11*c* continues to move upwards along the axis of the rotating column 4 after entering the guide groove 42 with the width substantially the same, until the pin 14*c* is completely extended out. In this process, the two ends of the rotating column 4 are limited and cannot move in an axial direction. When the poking part 11*c* slides into the guide groove 42, the rotating column 4 will be in a substantially stationary locking state. So that the adjacent poking part 11*d* of the US plug assembly 1*d* can be resisted. Meanwhile, when the rotating column 4 rotates, the movable pin 6 is driven to move horizontally and the two V-shaped ends abut against the two fan-shaped grooves 43 of the two rotating columns 4. The other rotating column 4 is also locked at a position and further locks the other two plug assemblies. Thus the EURO plug assembly 1*a* and the UK plug assembly 1*b* are locked.

Referring to FIG. 9 to FIG. 14, in the power plug adapter provided by the embodiment of the present invention, the groove bottom surface of the guide groove 42 are arc-shape. The side of the contacting surface of the four poking parts 11*a*, 11*b*, 11*c*, 11*d* with the guide groove 42 are also arc-shape to match with the groove bottom surface of the guide groove 42. When one of the poking parts 11*a*, 11*b*, 11*c*, 11*d* slides into the guide groove 42, the end face of each of the poking parts 11*a*, 11*b*, 11*c*, 11*d* can be better coupled with the guide groove 42 to form a surface contact and abrasion and abnormal sound caused by line contact or point contact can be avoided.

Please refer to FIG. 3 to FIG. 8 and FIG. 11 to FIG. 16, the power plug adapter of the present invention further comprises a locking assembly 5 to prevent the four plug assemblies 1*a*, 1*b*, 1*c*, 1*d* from extending out of the effective position of the top shell 26, and the plug pins 14*a*, 14*b*, 14*c*, 14*d* accidentally retracting under the action of an external force. The locking assembly 5 is elastically connected in the housing assembly 2 which comprises a bottom plate 51 and a plurality of supporting columns 53 extending from the bottom plate 51 along the direction of the sliding groove 22. Take the AU plug assembly 1*c* for example, the plastic body 10*c* corresponding to the plug assembly 1*c* can be blocked on the corresponding supporting columns 53 when the corresponding plug pin 14*c* extends out. When the pin 14*c* needs to be retracted, slide down the corresponding sliding button 15*c* and slightly slide up any one of the other three plug assemblies in a invalid position. For example, the EURO plug assembly 1*a*, the UK plug assembly 1*b* or the US plug assembly 1*d*. Therefore, the supporting column 53 on the bottom plate 51 is offset by a certain distance and the pin 14*c* can be unlocked and can be smoothly retracted into the housing assembly 2.

Further refer to FIG. 3 to FIG. 8 and FIG. 11 to FIG. 16, at least one of the supporting parts 12*a*, 12*b*, 12*c*, 12*d* is correspondingly provided on each of the plastic bodies 10*a*, 10*b*, 10*c*, 10*d*. A cutting groove 54 that supports each of the supporting parts 12*a*, 12*b*, 12*c*, 12*d* is arranged on the top of the corresponding supporting column 53. When the one of the plug pins 14*a*, 14*b*, 14*c*, 14*d* are fully extended, the corresponding supporting parts 12*a*, 12*b*, 12*c*, 12*d* can insert into the cutting groove 54 to prevent one of the plug pins 14*a*, 14*b*, 14*c*, 14*d* retracting. At least one inclined surface 55 is arranged on the side close to the bottom of the supporting column 53. The inclined surface 55 is used for abutting against the corresponding supporting parts 12*a*, 12*b*, 12*c*, 12*d* in an initial state. Each of the plug assembly is in the invalid position in an initial state. The locking assembly 5 is elastically connected in bottom shell 21. The corresponding supporting parts 12*a*, 12*b*, 12*c*, 12*d* of each of the four plug assemblies all abuts against the inclined surface 55. After sliding the corresponding sliding buttons 15*a*, 15*b*, 15*c*, 15*d*, the corresponding supporting parts 12*a*, 12*b*, 12*c*, 12*d* will slide upwards along the inclined surface and the bottom plate 51 of a locking assembly 5 is pushed to one side. When the bottom plate 51 reaches the top, it is automatically reset under the action of the spring 56, so as to play a role in locking other plug components. Therefore, the four plug assemblies 1*a*, 1*b*, 1*c*, 1*d* can be used.

In the present embodiment, two sides of each of the plastic bodies 10*a*, 10*b*, 10*c*, 10*d* are respectively provided with two or more supporting parts 12*a*, 12*b*, 12*c*, 12*d*. Therefore, each of the plug assemblies 1*a*, 1*b*, 1*c*, 1*d* can be in an effective use state and abnormal conditions of skew and instability are avoided.

Figure 15:
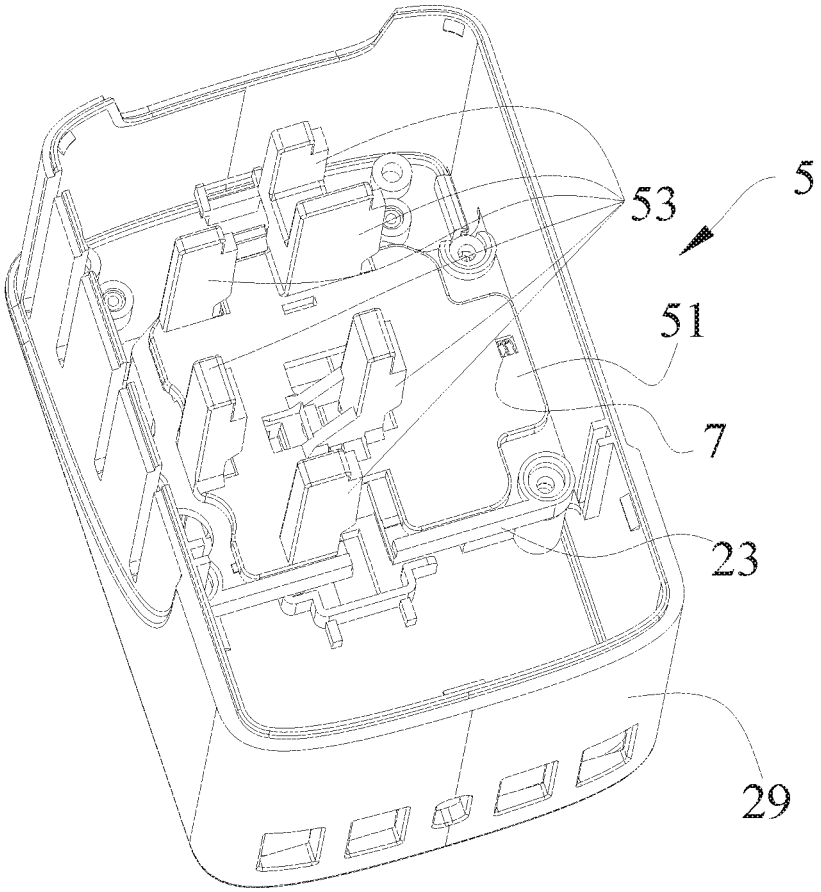
FIG. 15 is a schematic diagram of the power plug adapter of FIG. 1, with the locking assembly and the housing assembly combined.
Figure 16:
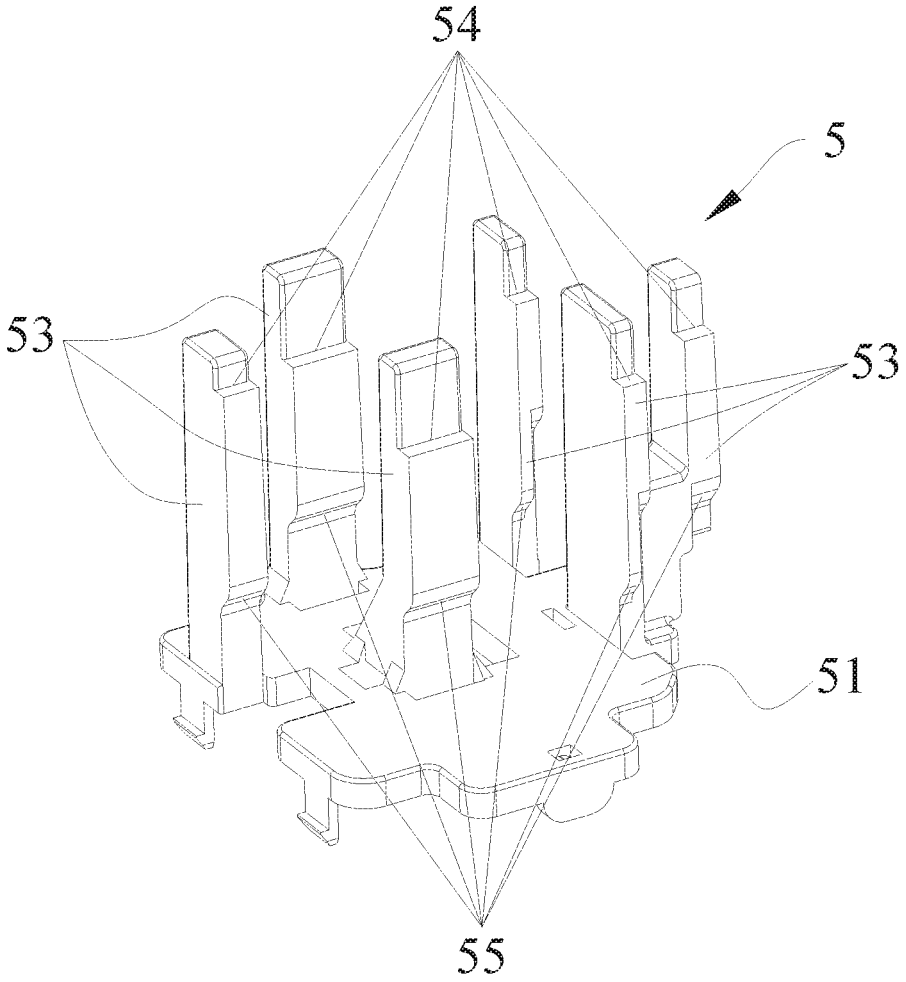
FIG. 16 is a three-dimensional view of the locking assembly of FIG. 15.

As shown in FIG. 15 and FIG. 16, in particular, the housing assembly 2 of the power plug adapter comprises a supporting block 23 fixedly arranged on the bottom shell 21. A first spring 7 is arranged between the supporting block 23 and the locking assembly 5 in an abutting mode. So that the locking assembly 5 and the housing assembly 2 can be elastically connected. Since the support block 23 is in sliding connection with the bottom plate 51 of the locking assembly 5, the supporting block 23 can also be used as a sliding track of the bottom plate 51.

The use state of the embodiments of the present invention will be described in detail below, so as to better explain the specific structural principle of the locking assembly 5. Please refer to FIG. 5 to FIG. 8, FIG. 13, FIG. 15, and FIG. 16, because the first spring 7 has a certain pre-tightening force in an initial state, the supporting parts 12*a*, 12*b*, 12*c*, 12*d* on each of the four plug assemblies 1*a*, 1*b*, 1*c*, 1*d* all abut against the inclined surface 55 on bottom of the supporting column 53. When it is required to use an AU plug assembly 1*c*, push the corresponding sliding button 15*c*. The locking assembly 5 on the bottom shell 21 can move elastically, and the supporting part 12*c* on the corresponding plastic body 10*c* all slide upwards to one side of the supporting column 53 by the corresponding inclined surface 55. When finally reaching the top end, the supporting column 53 returns to an initial position under the action of the first spring 7. Meanwhile, the cutting groove 54 at the top of the supporting column 53 will be used for supporting each supporting part 12*c*, so as to achieve the effect of locking the pin 14*c*. When it is not necessary to use an AU plug assembly 1*c*, push the corresponding sliding button 15*c* downwards and slightly slide upwards any of the plug assembly in a invalid position. For example, the EURO plug assembly 1*a*, the UK plug assembly 1*b* or the US plug assembly 1*d*. Therefore, the supporting column 53 on the bottom plate 51 is offset by a certain distance and the supporting part 12*c* on the corresponding plastic body 10*c* will be in a suspension state again. The initial state thereof can be restored by sliding button 15*c* at this time.

Please refer to FIG. 4 to FIG. 7, when sliding each of the plug assemblies 1*a*, 1*b*, 1*c*, 1*d*, abnormal conditions of skew and instability can be avoided by arranging at least four guide column 28 on the vertical direction of the bottom shell 21. Correspondingly, guide holes 13*a*, 13*b*, 13*c*, 13*d* are provided on each of the plastic bodies 10*a*, 10*b*, 10*c*, 10*d* of each of the four plug assemblies 1*a*, 1*b*, 1*c*, 1*d*. The guide column 28 is arranged in the guide holes 13*a*, 13*b*, 13*c*, 13*d* in a penetrating mode. In this way, when sliding each of the four plug assemblies 1*a*, 1*b*, 1*c*, 1*d*, the direction can be stable.

Further, continuing to refer to FIG. 4 to FIG. 7, when it is not necessary to use one of the four plug assemblies 1*a*, 1*b*, 1*c*, 1*d*, the plug assembly 1*a*, 1*b*, 1*c*, 1*d* will return to the invalid position from the effective position automatically. The power plug adapter in the present embodiment further comprises a second spring 8 in which each of the guide column 28 is inserted. The second spring 8 is abutted between the top shell 26 of the housing assembly and the plug assembly 1*a*, 1*b*, 1*c*, 1*d*. Specifically, the second spring 8 is abutted between the top shell 26 of the housing assembly and the corresponding plastic body 10*a*, 10*b*, 10*c*, 10*d* of each of the four plug assemblies 1*a*, 1*b*, 1*c*, 1*d*. Take the AU plug assembly 1*c* for example, when it is required to use an AU plug assembly 1*c*, push the corresponding sliding button upwards till the plug pin 14*c* extends out of the top shell 26 and the second spring is in a compression state. When it is not necessary to use an AU plug assembly 1*c*, slightly push the sliding button 15*a*, 15*b*, 15*d* upwards of any other plug assembly and the AU plug assembly 1*c* will automatically return to an initial position under the action of the second spring 8.

It should be noted that, as the attachment such as hardware connection piece, transformer, fuse, indication light the like and the circuit structure of each plug assembly inside the power adapter belongs to conventional technical means well known to one skilled in the art, and therefore are not described in detail herein.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. An electrical power plug adapter, comprising a housing assembly, four plug assemblies, two rotating columns and a movable pin, wherein each of the plug assemblies is movably arranged on the housing assembly to meet different standards, each of the rotating columns is vertically arranged in the housing assembly and only rotating around an axis, and the movable pin is arranged between the two rotating columns in an abutting mode; each of the plug assemblies comprising one or more plastic bodies, one or more plug pins fixed on the plastic bodies and one or more sliding buttons connected to one end of each of the plastic bodies; a plurality of sliding grooves for the sliding buttons to slide provided on a shell of the housing assembly; the plug pin passing through a pin slot arranged on the housing assembly when one of the sliding buttons slides upwards from the bottom to the top of one of the sliding grooves, the plastic body driving one of the two rotating columns to rotate to a preset angle, and the movable pin locking the other rotating column to resist the plastic bodies of other plug assemblies, wherein a guide groove and two guide surfaces are arranged on a peripheral wall of the two rotating columns, the guide groove extending in an axial direction, and the two guide surfaces being symmetrically arranged on two sides of the guide groove and extend to the bottom of the guide groove; one end of each of the two rotating columns provided with a fan-shaped groove, and two ends of the movable pin being V-shaped and abut in the two fan-shaped grooves; each plastic body convexly provided with a poking part matched with the width of the guide groove, the poking part sliding into the guide groove along one of the two guide surfaces when sliding the corresponding sliding button upwards from the bottom of one of the sliding grooves.

2. The electrical power plug adapter of claim 1, wherein each of the guide surfaces is an inclined curved.

3. The electrical power plug adapter of claim 1, wherein one side of the poking part is arc-shaped to match with the bottom of the guide groove.

4. The electrical power plug adapter of claim 1, further comprising a locking assembly which is elastically connected in the housing assembly, wherein the locking assembly comprises a bottom plate and a plurality of supporting columns extending from the bottom plate in a direction of each of the sliding grooves, the plastic bodies on the plug assemblies clamped on the corresponding supporting column when the corresponding plug pin extends out.

5. The electrical power plug adapter of claim 4, wherein at least one supporting part is arranged on the plastic bodies, and a cutting groove that supports the supporting part is arranged on the top of the corresponding supporting column; at least one inclined surface is arranged on a side close to the bottom each of the supporting columns to abut against the corresponding supporting part in an initial state.

6. The electrical power plug adapter of claim 5, wherein the housing assembly comprises a supporting block fixedly arranged inside the shell; a plurality of first springs being arranged between the supporting block and the locking assembly in an abutting mode.

7. The electrical power plug adapter of claim 4, further comprising at least four guide columns which are fixed on a bottom shell of the housing assembly, wherein each of the guide columns is inserted in the plastic body of each of the four plug assemblies.

8. The electrical power plug adapter of claim 7, further comprising a plurality of second springs in which each of the guide columns is inserted, wherein each of the second springs is respectively abutted between the housing assembly and each of the four plug assemblies.

9. The electrical power plug adapter according to claim 1, wherein the plug assemblies are selected from a group of plug assemblies conforming to the following country standards: EURO, UK, AU, US.

* * * * *